US012473921B2

(12) United States Patent
Hoernschemeyer

(10) Patent No.: US 12,473,921 B2
(45) Date of Patent: Nov. 18, 2025

(54) PORTABLE WATER PUMP ASSEMBLY

(71) Applicant: Zach Hoernschemeyer, Huntsville, AL (US)

(72) Inventor: Zach Hoernschemeyer, Huntsville, AL (US)

(73) Assignee: Cana Provisions, LLC, Huntsville, AL (US)

( * ) Notice: Subject to any disclaimer, the term of this patent is extended or adjusted under 35 U.S.C. 154(b) by 199 days.

(21) Appl. No.: 18/385,026

(22) Filed: Oct. 30, 2023

(65) Prior Publication Data

US 2024/0141901 A1 May 2, 2024

Related U.S. Application Data

(60) Provisional application No. 63/420,550, filed on Oct. 29, 2022.

(51) Int. Cl.
*F04D 13/06* (2006.01)
*F04B 17/03* (2006.01)
(Continued)

(52) U.S. Cl.
CPC ..... *F04D 13/06* (2013.01); *F04B 17/03* (2013.01); *F04B 39/0044* (2013.01); *F04B 39/12* (2013.01); *F04B 39/121* (2013.01); *F04B 53/003* (2013.01); *F04B 53/16* (2013.01); *F04B 53/22* (2013.01); *F04D 29/4293* (2013.01);
(Continued)

(58) Field of Classification Search
CPC .... F04B 39/0044; F04B 39/121; F04B 17/03; F04B 39/12; F04B 53/16; F04B 53/22; F04B 53/003; F04D 29/605; F04D 29/4293; F04D 29/708; F04D 29/601; F04D 29/628; F04D 29/669; F04D 13/06; F04D 29/60; F04C 2230/604; F04C 2270/12
See application file for complete search history.

(56) References Cited

U.S. PATENT DOCUMENTS 2,162,076 A * 6/1939 Frimand ..... A61M 1/064 604/74
2,711,285 A * 6/1955 Burrowes ..... F04D 29/626 417/326
(Continued)

FOREIGN PATENT DOCUMENTS

WO 2005099043 A2 10/2005

*Primary Examiner* — Peter J Bertheaud
(74) *Attorney, Agent, or Firm* — Asgaard Patent Services, LLC; F. Wayne Thompson, Jr.

(57) ABSTRACT

A water pump assembly comprises an electric water pump, a suction-intake arm assembly, a discharge arm assembly, and a chassis configured to dampen vibrations generated by the electric water pump during operation. The electric water pump includes a pump motor, an inlet port, and an outlet port. The suction-intake arm assembly is connected to the inlet port, and the discharge arm assembly is connected to the outlet port. The chassis includes a baseboard and a yoke. The baseboard includes one or more vibration isolators on an underside thereof. The yoke includes a first opening configured to fit about a portion of the electric water pump, a second opening configured to support one end of the suction-intake arm assembly, and a third opening configured to support one end of the discharge arm assembly.

11 Claims, 16 Drawing Sheets

(51) Int. Cl.

| | |
|---|---|
| ***F04B 39/00*** | (2006.01) |
| ***F04B 39/12*** | (2006.01) |
| ***F04B 53/00*** | (2006.01) |
| ***F04B 53/16*** | (2006.01) |
| ***F04B 53/22*** | (2006.01) |
| ***F04D 29/42*** | (2006.01) |
| ***F04D 29/60*** | (2006.01) |
| ***F04D 29/62*** | (2006.01) |
| ***F04D 29/66*** | (2006.01) |
| ***F04D 29/70*** | (2006.01) |

(52) U.S. Cl.

CPC ..... *F04D 29/60* (2013.01); *F04D 29/601* (2013.01); *F04D 29/605* (2013.01); *F04D 29/628* (2013.01); *F04D 29/669* (2013.01); *F04D 29/708* (2013.01); *F04C 2230/604* (2013.01); *F04C 2270/12* (2013.01)

(56) References Cited

U.S. PATENT DOCUMENTS

| | | | | |
|---|---|---|---|---|
| 5,419,497 | A | 5/1995 | Warrington | |
| 5,524,860 | A * | 6/1996 | Ives | F04B 39/12 62/465 |
| 6,135,726 | A * | 10/2000 | Robertson | F01C 21/007 417/363 |
| 6,234,445 | B1 * | 5/2001 | Yoon | B62D 27/065 248/638 |
| 9,413,204 | B2 * | 8/2016 | Ota | F04B 17/03 |
| 9,660,497 | B2 | 5/2017 | Ladd | |
| 10,830,223 | B2 * | 11/2020 | Qi | B60H 1/3229 |
| 2006/0034707 | A1 * | 2/2006 | Thomas | F04B 17/03 417/410.1 |
| 2017/0122325 | A1 | 5/2017 | Seman, Jr. et al. | |

* cited by examiner

PORTABLE WATER PUMP ASSEMBLY

CROSS-REFERENCE TO RELATED APPLICATION(S)

This application claims the benefit of U.S. Provisional Application Ser. No. 63/420,550, filed on Oct. 29, 2022, the entirety of which is incorporated herein by reference.

TECHNICAL FIELD

This disclosure relates to a portable water pump assembly, and specifically to a water pump assembly used as part of a water filtration system.

BACKGROUND

It is well known to provide a fluid pump that has a housing with a fluid inlet and a fluid outlet, a motor within the housing, and an impeller or diaphragm driven by the motor for drawing fluid, such as water, through the fluid inlet and moving the fluid from the inlet to the fluid outlet. These fluid pumps have been widely used in various applications including, but not limited to, irrigation, industrial processes, and water supply systems. These existing fluid pumps present several drawbacks, such as being noisy and visually conspicuous. These are critical problems if the fluid pump is being used in contested environments where not drawing attention is paramount.

Accordingly, needs exist for the portable water pump assembly disclosed herein. It is to the provision of a portable water pump assembly configured to address these needs, and others, that the present invention is primarily directed.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a portable water pump assembly that comprises an electric water pump and a chassis configured to dampen vibrations generated by the water pump during operation. In some implementations, the portable water pump assembly includes a power supply configured to protect the water pump from overcurrent.

An example water pump assembly comprises an electric water pump, a suction-intake arm assembly, a discharge arm assembly, and a chassis configured to dampen vibrations generated by the electric water pump during operation. The electric water pump comprises a pump motor, an inlet port, and an outlet port. The suction-intake arm assembly is connected to the inlet port and the discharge arm assembly is connected to the outlet port. The chassis comprises a baseboard and a yoke. The baseboard includes one or more vibration isolators on an underside thereof. The yoke comprises a first opening configured to fit about a portion of the electric water pump, a second opening configured to support one end of the suction-intake arm assembly, and a third opening configured to support one end of the discharge arm assembly.

In some implementations, the water pump assembly further comprises a power supply that includes an electronic circuit contained within an electronics enclosure. The electronic circuit comprises a printed circuit board configured to protect the electric water pump from overcurrent. The printed circuit board comprises an inrush current limiter and a removable fuse. The inrush current limiter is configured to prevent an EMF surge from damaging the removable fuse.

Also disclosed herein is an electrical connector configured to conductively interface with the power supply, through the electrical connector is not limited to this single use case. The electrical connector is a Powerpole compatible connector.

An example electrical connector comprises a first housing within which is mounted a genderless electrical contact, a second housing within which is mounted a genderless electrical contact, and a protective boot configured to hold the first housing and the second housing together. The first housing and the second housing are positioned side-to-side, thereby forming an opening therebetween. This opening is oriented perpendicular to the length of the first and second housings. The protective boot includes a pair of deflectable latches configured and positioned to engage opposite ends of the opening formed between the first and second housings.

BRIEF DESCRIPTION OF THE DRAWINGS

Like reference numerals refer to corresponding parts throughout the several views of the drawings.

DETAILED DESCRIPTION

Figure 1:
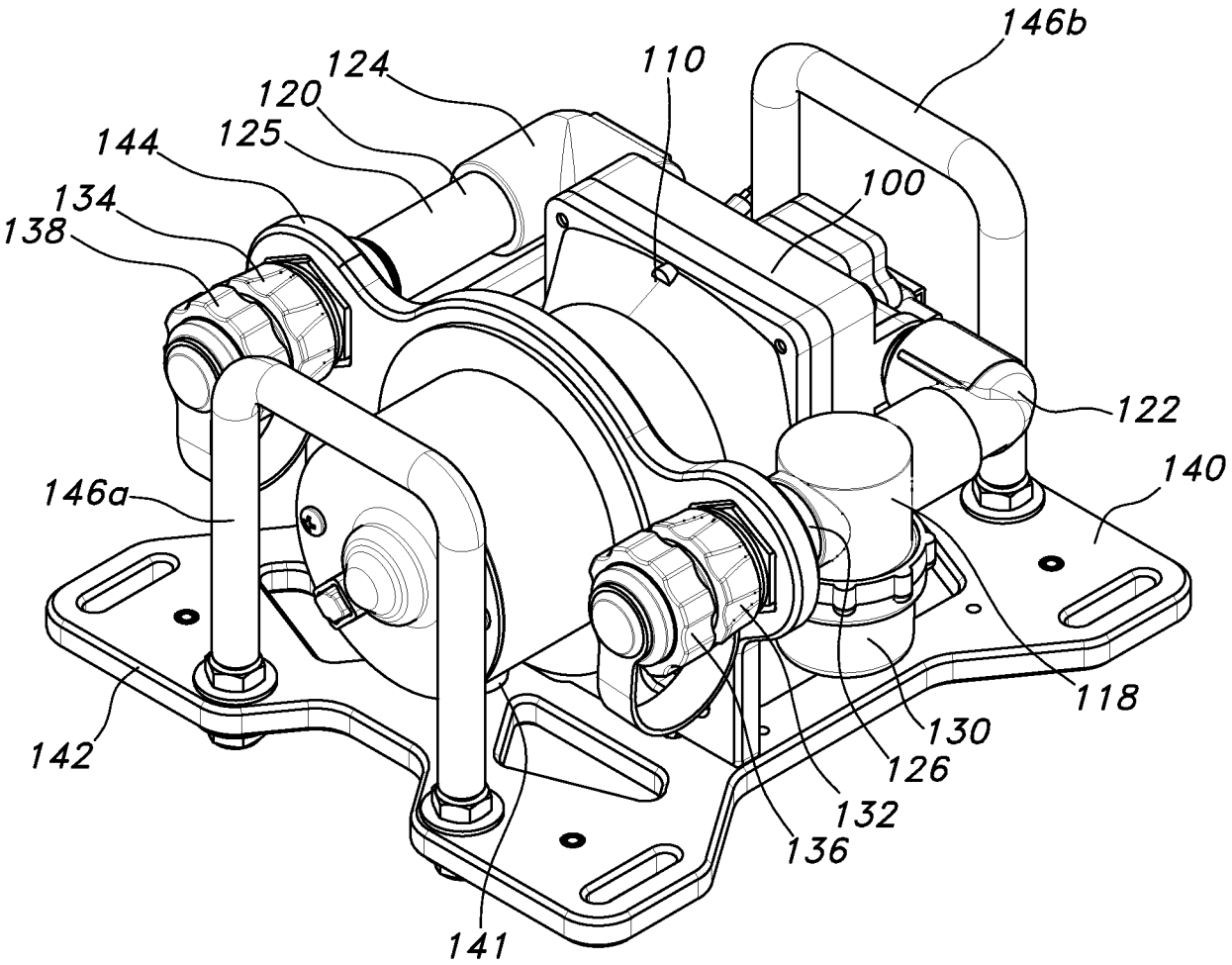
FIG. 1 is an isometric view of a portable water pump assembly according to the principles of the present disclosure.
Figure 2:
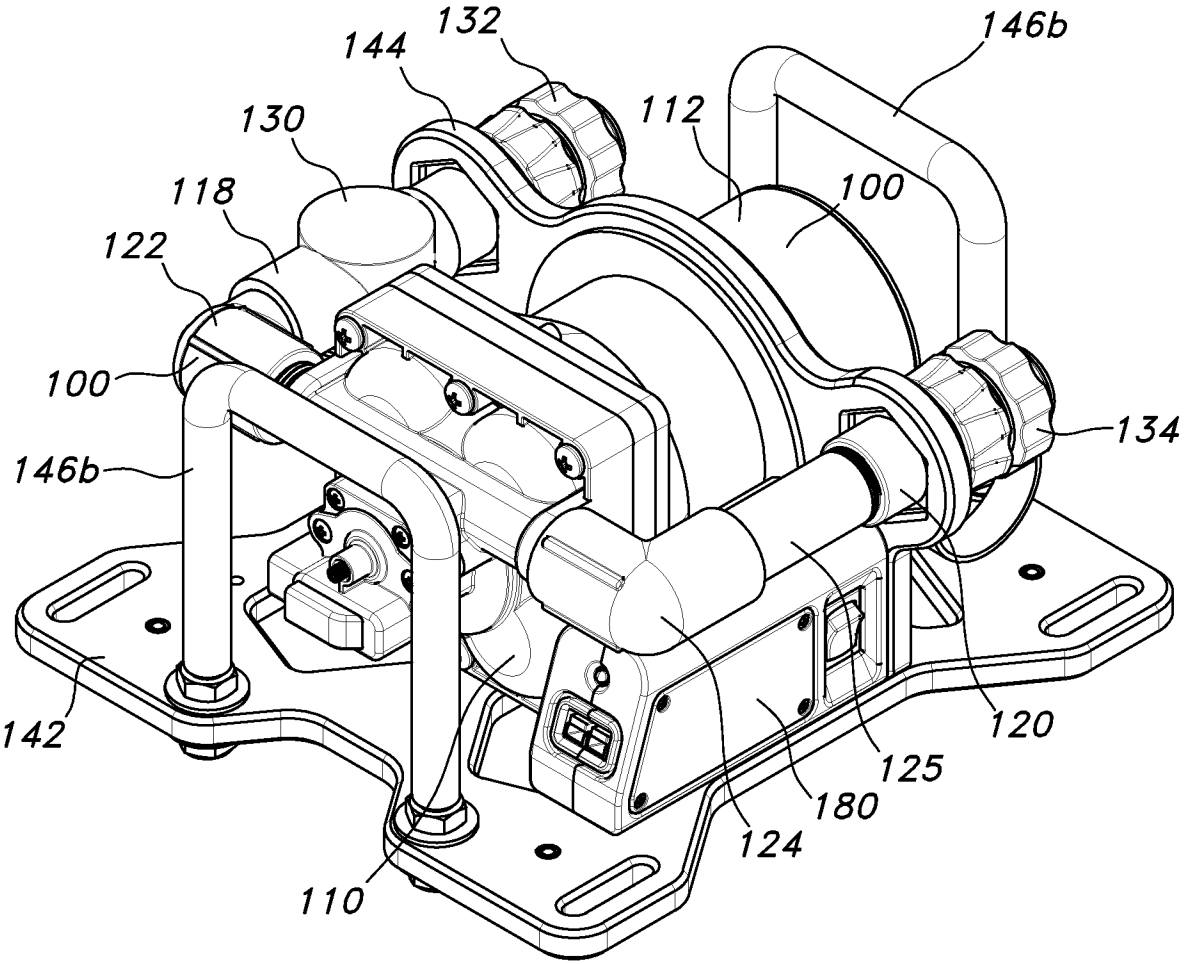
FIG. 2 is another isometric view of the portable water pump assembly shown in FIG. 1.

FIGS. 1 and 2 illustrate a portable water pump assembly 100 according to the principles of the present disclosure. The portable water pump assembly 100 comprises an electric water pump 110 and a chassis 140 configured to dampen vibrations generated by the water pump 110 during operation. In some implementations, the portable water pump assembly 100 also includes a power supply 180, positioned under the discharge arm assembly 120, that is electrically connected to the water pump 110 (see, e.g., FIG. 2). The power supply 180 is configured to supply power to the water pump 110 and to protect the water pump 110 from excess current. In some implementations, the power supply 180 is configured to convert electric current from a power source to the correct voltage and/or current used by the water pump 110.

The example water pump 110 is configured to move water and comprises a pump motor 112, an inlet port 114, and an outlet port 116. The pump motor 112 is a DC motor that, in the preferred embodiment, is powered by a 12-volt power source. The example water pump 110 is a Seaflo Diaphragm Pump, model SE57FR, that runs on DC power. However, other suitably configured electric water pumps could be used.

Figure 3:
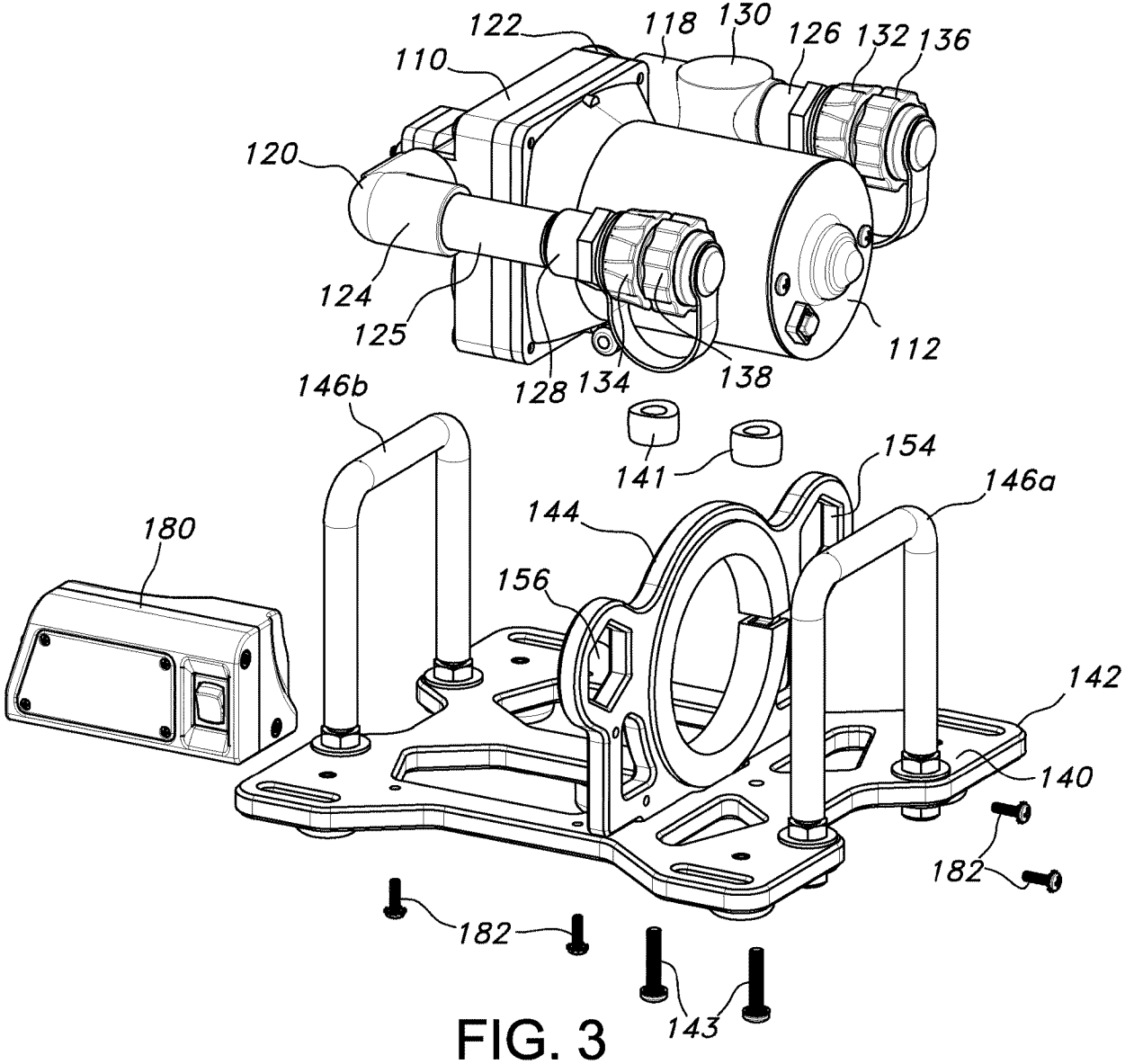
FIG. 3 is an exploded view of the portable water pump assembly shown in FIG. 1.

As shown best in FIGS. 1-3, a suction-intake arm assembly 118 and a discharge arm assembly 120 are connected to the inlet port 114 and the outlet port 116, respectively, of the water pump 110.

The suction-intake arm assembly 118 comprises a 90° elbow fitting 122, an inline filter 130, and a garden hose thread (GHT) adapter 126. The elbow fitting 122 is attached to a proximal end of the inline filter 130 and the GHT adapter 126 is attached to a distal end of the inline filter 130. The suction-intake arm assembly 118 is connected to the inlet port 114 of the water pump 110 by the elbow fitting 122. The inline filter 130 is configured to prevent debris from entering and damaging the water pump 110. A female quick connect fitting 132 for a garden hose, well known to those of ordinary skill in the art, is threadedly secured to the GHT adapter 126 of the suction-intake arm assembly 118. As shown, a plug 136 can be used to seal the GHT adapter 126 when a hose is not attached thereto.

The discharge arm assembly 120 comprises a 90° elbow fitting 124, a length of pipe 125, and a GHT adapter 128. The elbow fitting 124 is attached to a proximal end of the pipe 125 and the GHT adapter 128 is attached to a distal end of the pipe 125. The discharge arm assembly 120 is connected to the outlet port 116 of the water pump 110 by the elbow fitting 124. A female quick connect fitting 134 for a garden hose, well known to those of ordinary skill in the art, is threadedly secured to the GHT adapter 128 of the discharge arm assembly 120. As shown, a plug 138 can be used to seal the GHT adapter 128 when a hose is not attached thereto.

The example chassis 140 is configured to serve as a base for the water pump 110 and to dampen vibrations generated by the water pump 110 during operation. The chassis 140 comprises a baseboard 142, a yoke 144, and, in some implementations, a pair of handles 146 (see, e.g., FIG. 3). The baseboard 142 and yoke 144 of the chassis 140 are made of high-density polyethylene (HDPE), but could be made of another suitable material or combination of materials. In particular, the material(s) used should be selected based on frequency response and flexibility.

Figure 6:
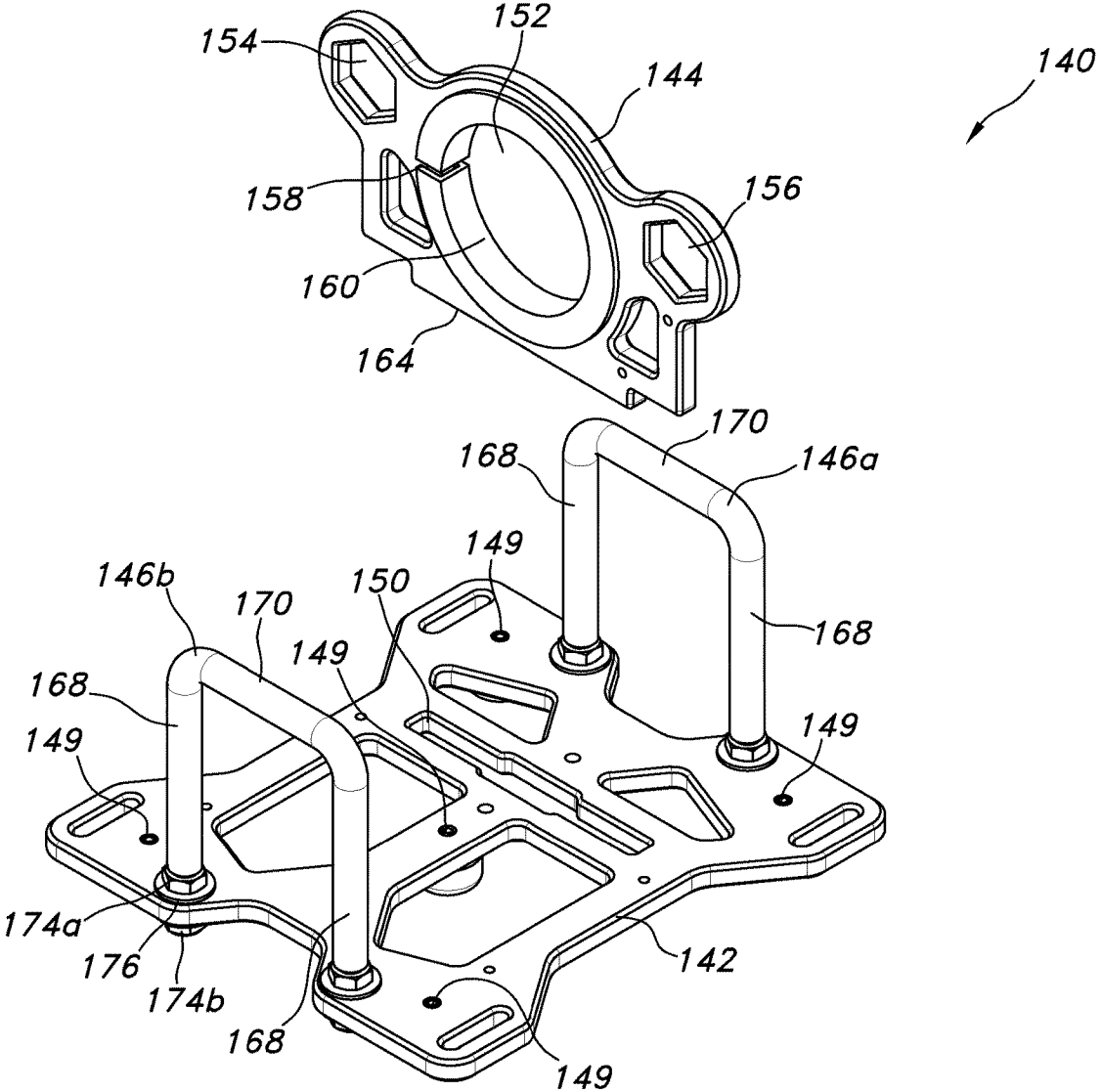
FIG. 6 is an isometric view of the chassis shown in FIG. 1, wherein the yoke is shown exploded from the baseboard.
Figure 7:
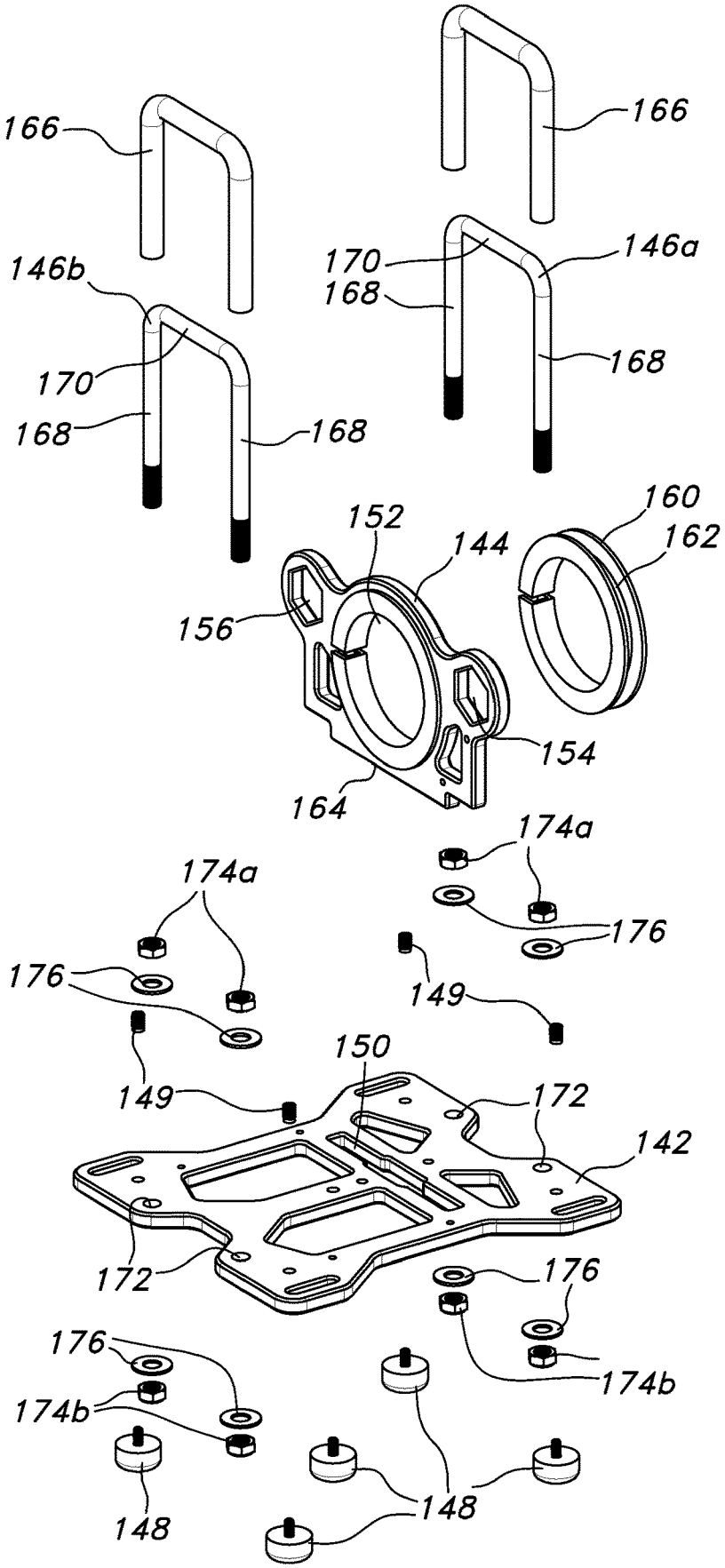
FIG. 7 is an exploded view of the chassis shown in FIG. 5.

The baseboard 142 of the chassis 140 is configured to rest on a horizontal surface and to hold up the yoke 144. Five rubber feet 148 are threadedly secured to a bottom side of the baseboard 142. However, in some implementations, there may be more or fewer than five rubber feet 148 on the bottom side of the baseboard 142. The rubber feet 148 act as vibration isolators, reducing vibration and sound generated by the portable water pump assembly 100 during operation. In some implementations, the baseboard 142 includes a metal threaded insert 149 for each of the rubber feet 148 to thread into (see, e.g., FIG. 6). The baseboard 142 also includes a transverse slot 150 therein, the purpose of which will be described below.

Figure 5:
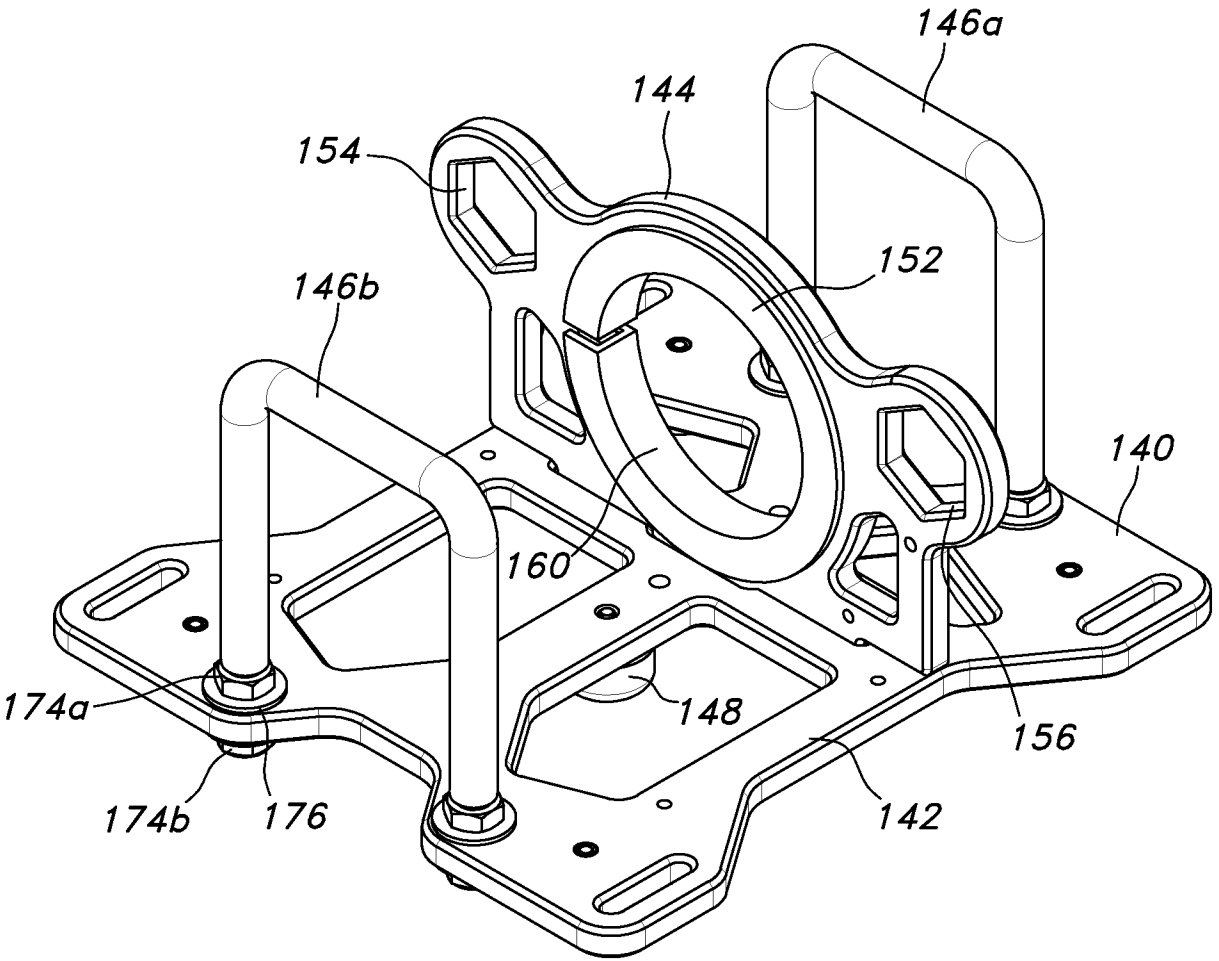
FIG. 5 is an isometric view of the chassis shown in FIG. 1.

As shown in FIGS. 1 and 2, the yoke 144 of the chassis 140 is configured to support the barrel 112 of the water pump 110, one end of the suction-intake arm assembly 118, and one end of the discharge arm assembly 120. The yoke 144 comprises a barrel support opening 152, an opening 154 for securing the suction-intake arm assembly 118, and an opening 156 for securing the discharge arm assembly 120 (see, e.g., FIG. 5).

As shown in FIGS. 1 and 2, the barrel support opening 152 in the yoke 144 is configured to fit about a portion of the pump barrel 112. The barrel support opening 152 is a generally circular opening that extends through the yoke 144. A wiring notch 158 in the edge of the barrel support opening 152 allows wires connecting the water pump 110 to the power supply 180 to pass therethrough, alongside the pump barrel 112. The barrel support opening 152 is lined with rubber edging 160 that dampens vibrations generated by the water pump 110 during operation. The rubber edging 160 is a length of flexible rubber material that does not overlay the wiring notch 158 in the barrel support opening 152. The rubber edging 160 includes a longitudinally extending groove 162 that receives therein the inner edge of the barrel support opening 152.

The opening 154 in the yoke 144 for securing the suction-intake arm assembly 118 is configured to receive therein the GHT adapter 126 connecting the female quick connect fitting 132 to the inline filter 130 of the suction-intake arm assembly 118. In some implementations, the opening 154 is a hex-shaped opening sized to receive the hex-shaped body of the female quick connect fitting 132. In this way, the opening 154 is configured to minimize, or eliminate, deflection of the suction-intake arm assembly 118.

The opening 156 in the yoke 144 for securing the discharge arm assembly 120 is configured to receive therein the GHT adapter 128 connecting the female quick connect fitting 134 to the pipe 125 of the discharge arm assembly 120. In some implementations, the opening 156 is a hex-shaped opening sized to receive the hex-shaped body of the female quick connect fitting 134. In this way, the opening 156 is configured to minimize, or eliminate, deflection of the discharge arm assembly 120.

The yoke 144 further comprises a tab 164 that extends from a bottom edge of the yoke 144. The tab 164 is configured to fit snugly into the slot 150 in the baseboard 142 of the chassis 140, thereby positioning the yoke 144 in a substantially perpendicular orientation relative to the baseboard 142.

The handles 146 of the chassis 140 can be used to lift the portable water pump assembly 100. The handles 146 also act as crash bars, protecting the front and rear of the water pump 110 from impact. In the preferred implementation, each handle (146*a*, 146*b*) is a square bend U-bolt with a neoprene cover 166. Each handle (146*a*, 146*b*) includes spaced apart, substantially parallel opposing legs 168 extending outwardly from a square bend 170 (see, e.g., FIG. 6). The legs 168 of each handle (146*a*, 146*b*) extend through a pair of apertures 172 in the baseboard 142 that are arranged and configured to receive the legs 168. Each leg 168 is secured to the baseboard 142 by a combination of threaded fasteners 174 and washers 176. Example threaded fasteners 174 include a stainless-steel nut 174*a* and a nyloc nut 174*b* (i.e., a locknut with a nylon collar).

As shown in FIGS. 1 and 3, two elastomeric bushings 141 are positioned between the underside of the pump barrel 112 and the topside of the baseboard 142. Each elastomeric bushing 141 is a hollow cylinder made of an elastomer (e.g., rubber). The elastomeric bushings 141 act as vibration isolators, minimizing transmission of vibrations between the pump barrel 112 and the baseboard 142 of the chassis 140.

Two threaded fasteners 143 are used to further secure the pump barrel 112 to the baseboard 142 of the chassis 140 (see, e.g., FIG. 3). Each fastener 143 extends through an opening in the baseboard 142, through one of the elastomeric bushings 141, and is threadedly received within an opening in the underside of the pump barrel 112 (not shown).

The power supply 180 of the portable water pump assembly 100, shown in FIGS. 3-4 and 8-11, is conductively connected to the water pump 110 by an electrical cable (not shown). The power supply 180 comprises an electronic circuit 184 contained within an electronics enclosure 186 (see, e.g., FIG. 11).

The electronic circuit 184 comprises an ON/OFF switch 188, a LED indicator light 190, a power input connection 192, and a printed circuit board (PCB) 194.

The ON/OFF switch 188 is used to turn the water pump 110 ON and OFF. The example ON/OFF switch 188 is a rocker switch. However, another type of switch could be used. The ON/OFF switch 188 is positioned within a recess on a side of the electronics enclosure 186 (see, e.g., FIG. 8).

Figure 8:
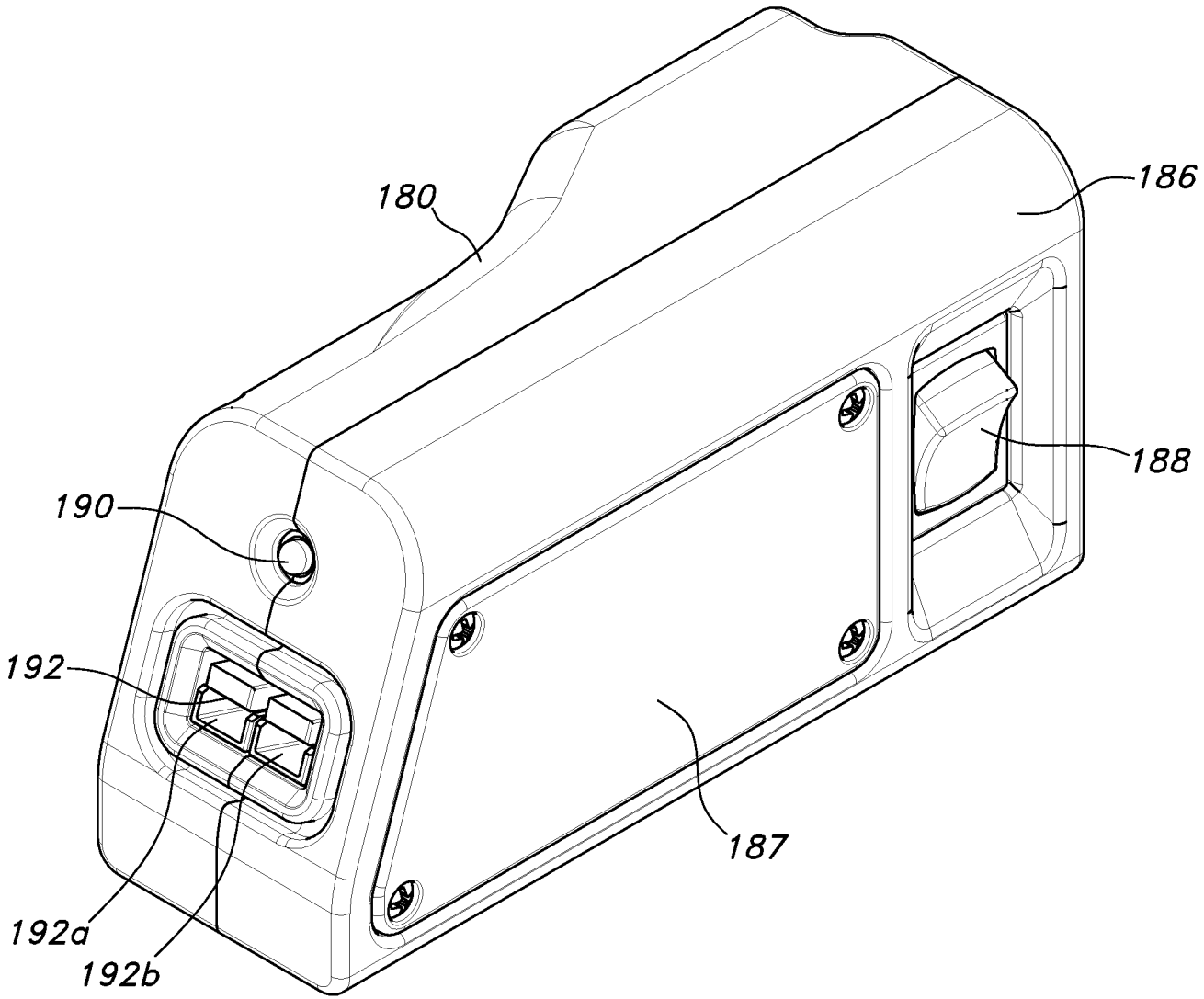
FIGS. 8-10 are isometric views of the power supply.
Figure 9:
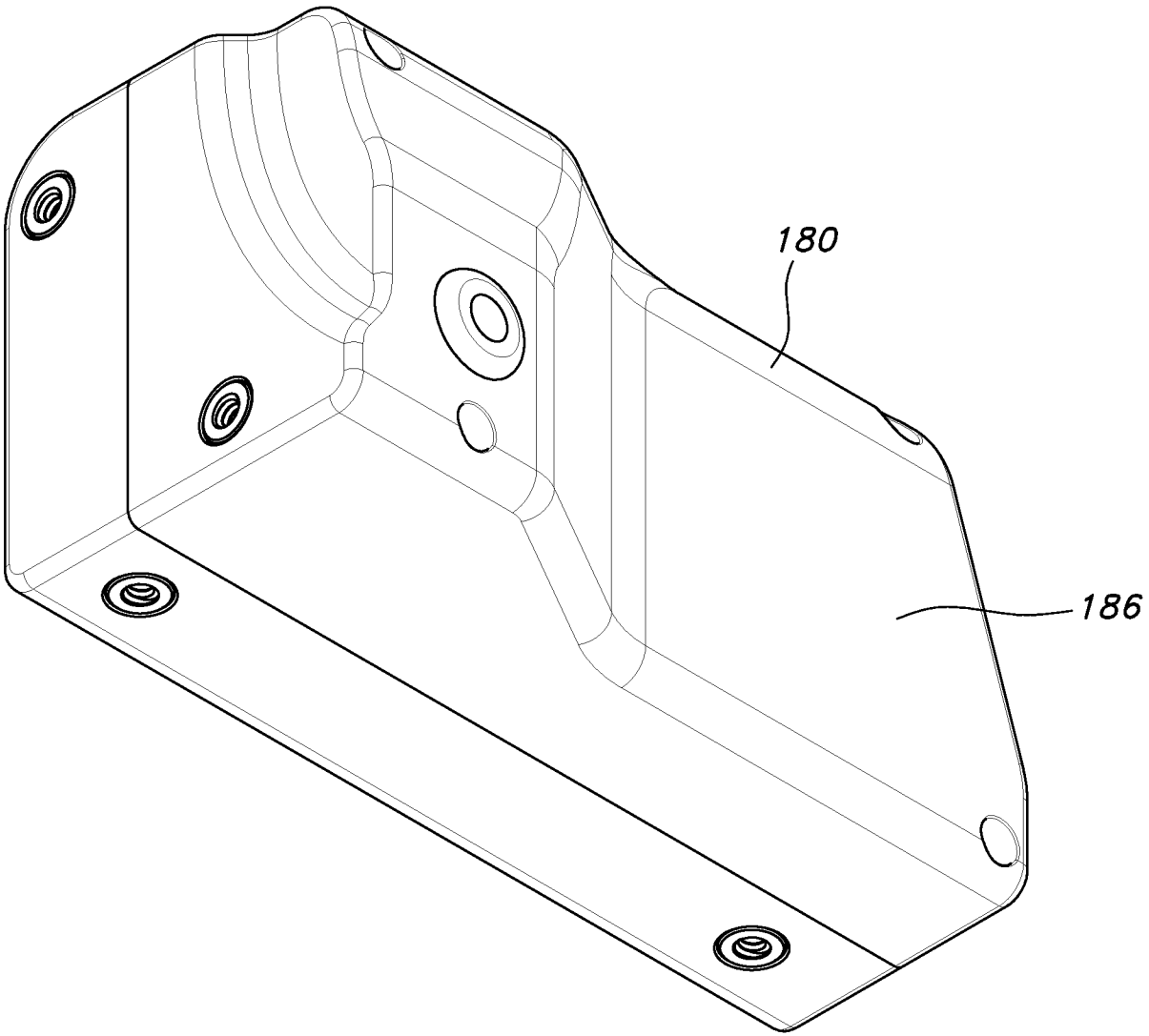
Figure 10:
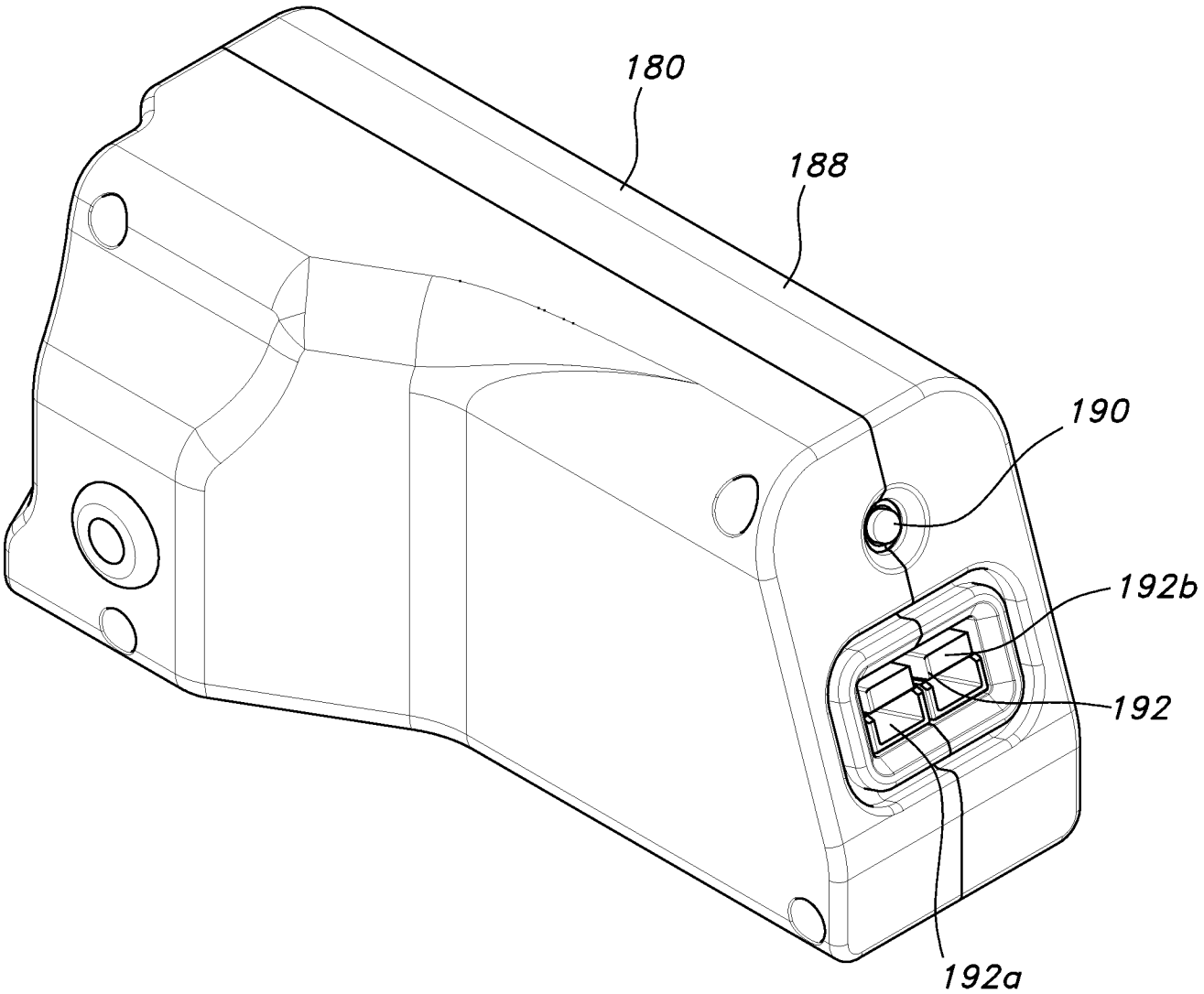
Figure 11:
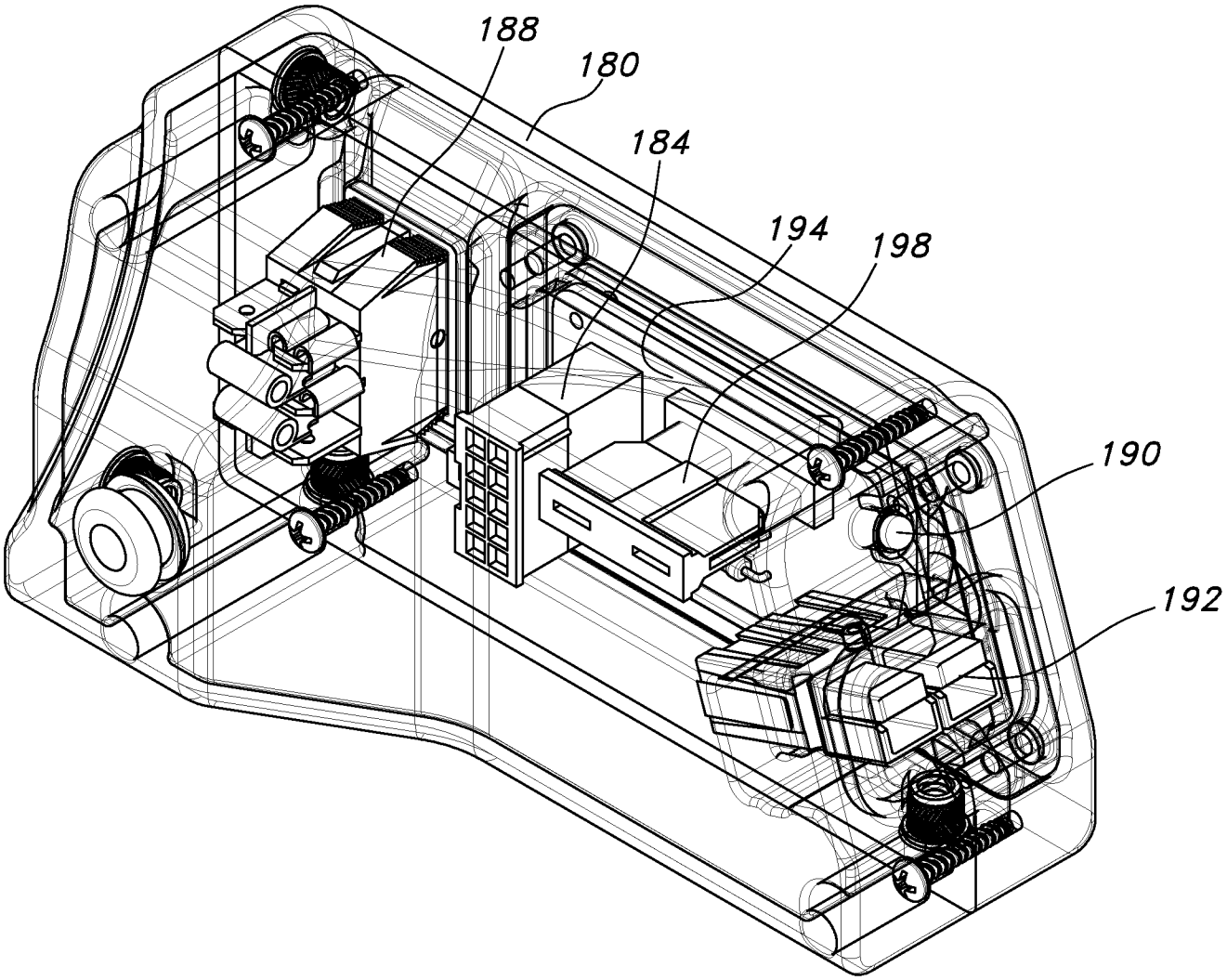
FIG. 11 is another isometric view of the power supply shown in FIGS. 8-10, wherein the electronics enclosure is transparent.
Figure 12:
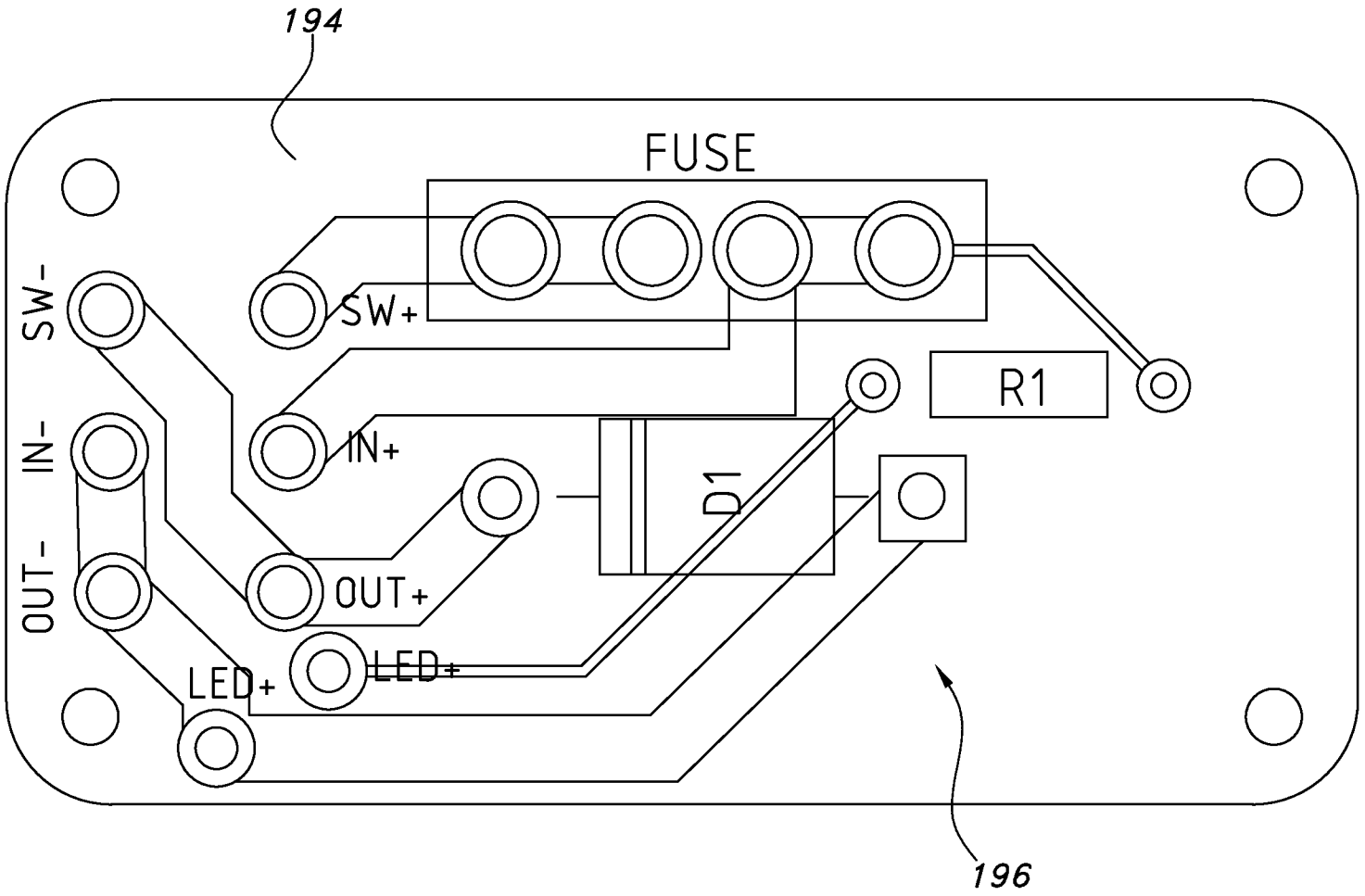
FIGS. 12 and 13 are plan views of an example printed circuit board (PCB) according to the principles of the present disclosure.
Figure 13:
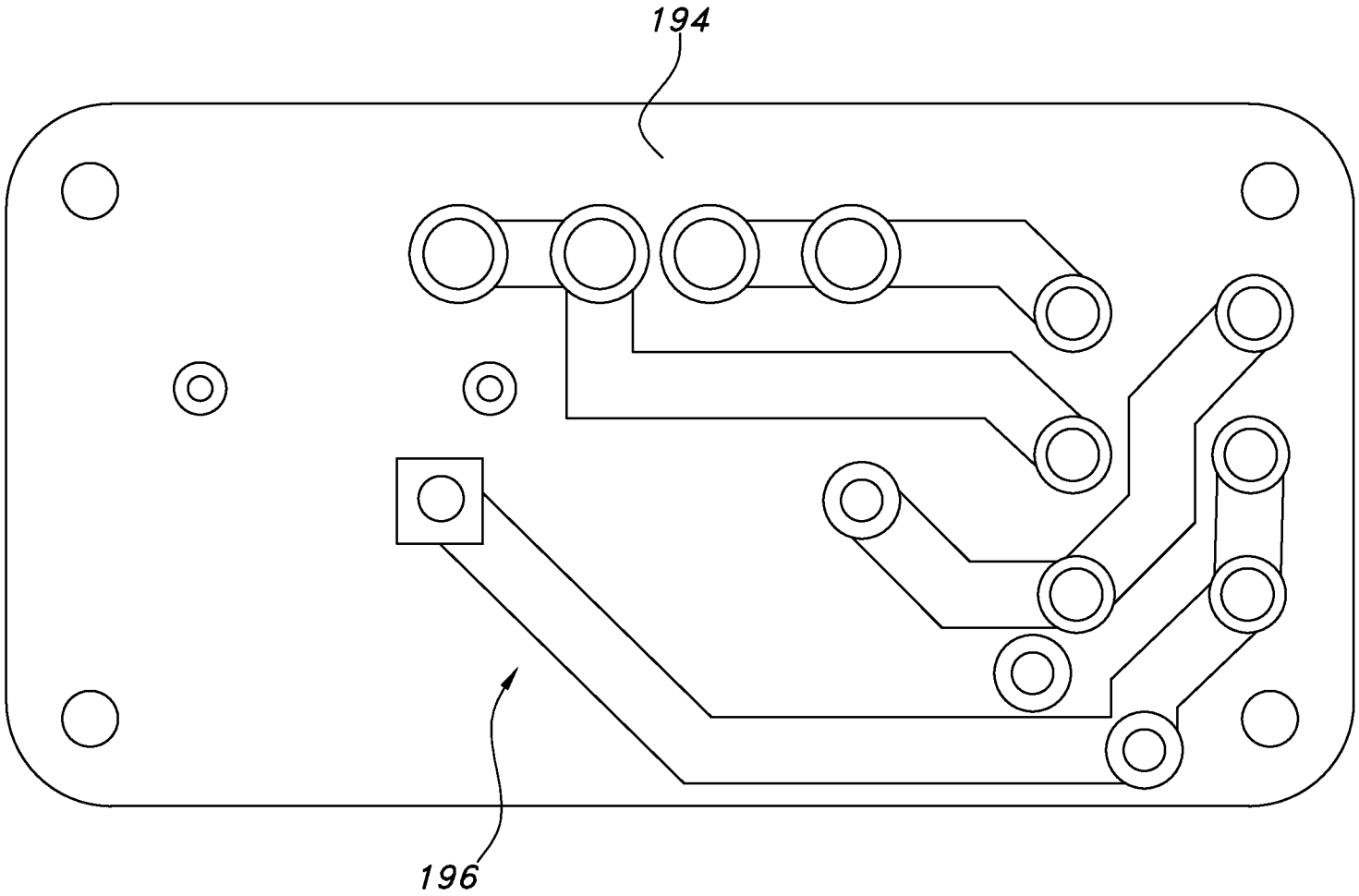

The light emitting diode (LED) of the indicator light 190 is positioned within a recessed opening in the exterior of the electronics enclosure 186 (see, e.g., FIG. 8). The indicator light 190 provides visual indication that an electrical power source is connected to the power supply 180 (i.e., the LED lights up when a power source, providing electrical current, is connected to the power input connection 192 of the power supply 180).

The power input connection 192 comprises a pair of electrical connectors 192*a*, 192*b* (e.g., Powerpole connectors) positioned within a recess in the electronics enclosure 186. The power input connection 192 is used to connect a power source (e.g., a car battery) to the water pump 110. The power input connection 192 is positioned below the LED indicator light 190. The electronic circuit 184 is configured so that connecting a power source to the power input connection 192 causes the LED indicator light 190 to illuminate.

The PCB 194 is configured to protect the water pump 110 from overcurrent. The PCB 194 comprises an inrush current limiter 196 and a removable fuse 198. The removable fuse 198 (e.g., a 10-amp blade fuse) provides overcurrent protection for the water pump 110. In this way, the water pump 110 is protected from a connected power source providing excess current. The inrush current limiter 196 is configured to prevent an electromagnetic field (EMF) surge, generated when the water pump 110 is turned ON and OFF, from damaging the removable fuse 198. The inrush current limiter 196 and fuse 198 work in tandem to increase the service life of the water pump 110 and reduce the frequency of fuse 198 replacement.

Figure 4:
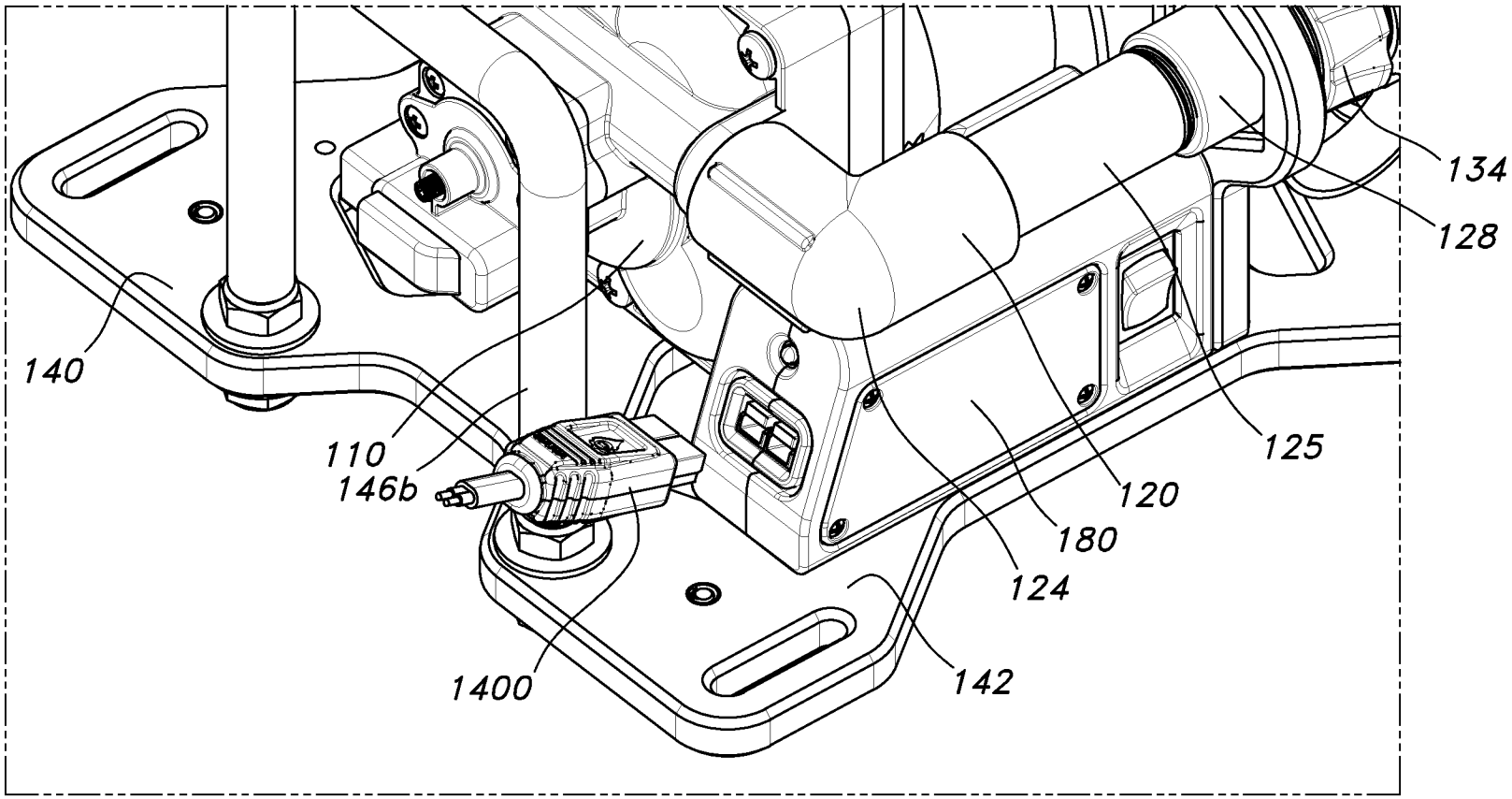
FIG. 4 is a closeup view of the power supply shown in FIG. 2 and an electrical connector according to the principles of the present disclosure.

As shown in FIGS. 3 and 4, the electronics enclosure 186 is secured by threaded fasteners 182 to the baseboard 142 and yoke 144 of the chassis 140. As shown best in FIG. 8, the electronics enclosure 186 includes a removable panel 187 that provides access to its interior. The removable panel 187 is configured to cover an opening into the interior of the electronics enclosure 186 and is secured in position by threaded fasteners. The PCB 194 is attached to the interior side of the removable panel 187 by threaded fasteners (see, e.g., FIG. 11). The removable panel 187 facilitates end user replacement of the fuse 198.

Although not shown in the drawings, it will be understood that suitable wiring and/or traces connect the electrical components of the power supply 180 disclosed herein.

As shown in FIGS. 4 and 14-16, an electrical connector 1400 configured to conductively interface with the power input connection 192 of the power supply 180 is also provided. The electrical connector 1400 is used to connect a power source (e.g., a car battery) to the power supply 180 of the portable water pump assembly 100. The electrical connector 1400, a Powerpole compatible connector, comprises a first housing 1410 within which is mounted a genderless electrical contact 1412, a second housing 1420 within which is mounted a genderless electrical contact 1422, and a protective boot 1430 configured to hold the first housing 1410 and the second housing 1420 together.

Each housing (1410, 1420) of the electrical connector 1400 is configured to accurately position and maintain the position of the electrical contact (1412, 1422) mounted within the housing. Each housing (1410, 1420) is a Powerpole connector, or equivalent, well known to those of ordinary skill in the art. The first and second housings (1410, 1420) can be attached side-to-side, forming an opening 1428 therebetween (see, e.g., FIG. 15). The opening 1428 is oriented perpendicular to the length of the housings (1410, 1420). In the preferred embodiment, the opening 1428 is a cylindrical bore.

The protective boot 1430 of the electrical connector 1400 is configured to accurately position and maintain the position of the housings (1410, 1420) within the protective boot 1430. The housing cavity 1432 defined by the protective boot 1430 includes a rear wall section 1434 that provides a mechanical stop to prevent movement of the housings (1410, 1420) to the left as viewed in FIG. 16. The protective boot 1430 also includes a pair of deflectable latches 1436 configured and positioned to engage opposite ends of the opening 1428 formed between the housings (1410, 1420). Each deflectable latch 1436 includes an inwardly extending end stop, or tab 1438, that engages one end of the opening 1428. Each end stop, or tab 1438, extends from a wall of the housing cavity 1432 and has a circular cross section. The deflectable latches 1436 provide a mechanical stop that prevents movement of the housings (1410, 1420) to the right as viewed in FIG. 16. Succinctly put, the protective boot 1430 is configured to prevent longitudinal movement of the housings (i.e., movement of the housings (1410, 1420) to the left and right as viewed in FIG. 16).

Figure 14:
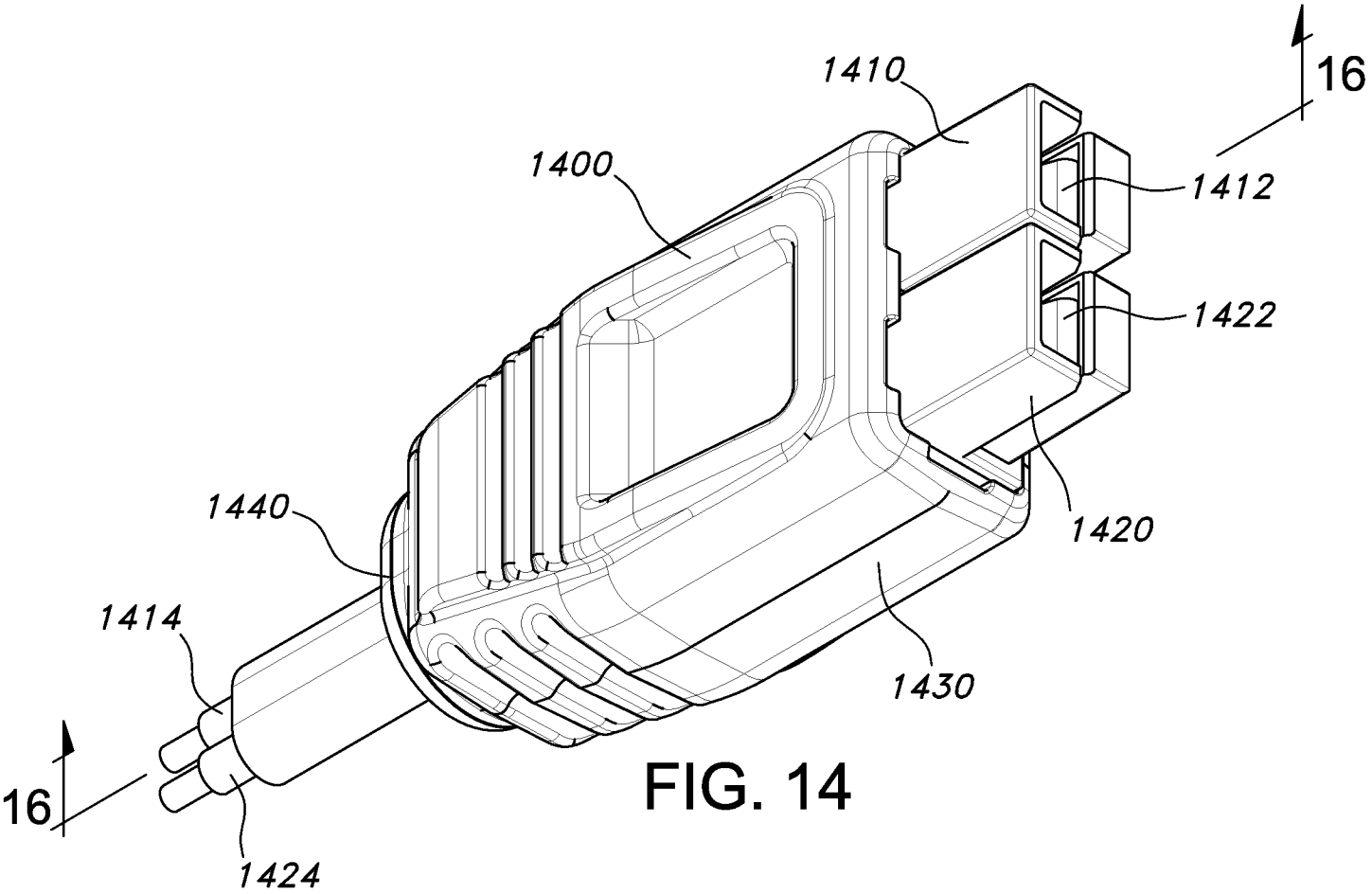
FIG. 14 is an isometric view of the electrical connector shown in FIG. 4.
Figure 15:
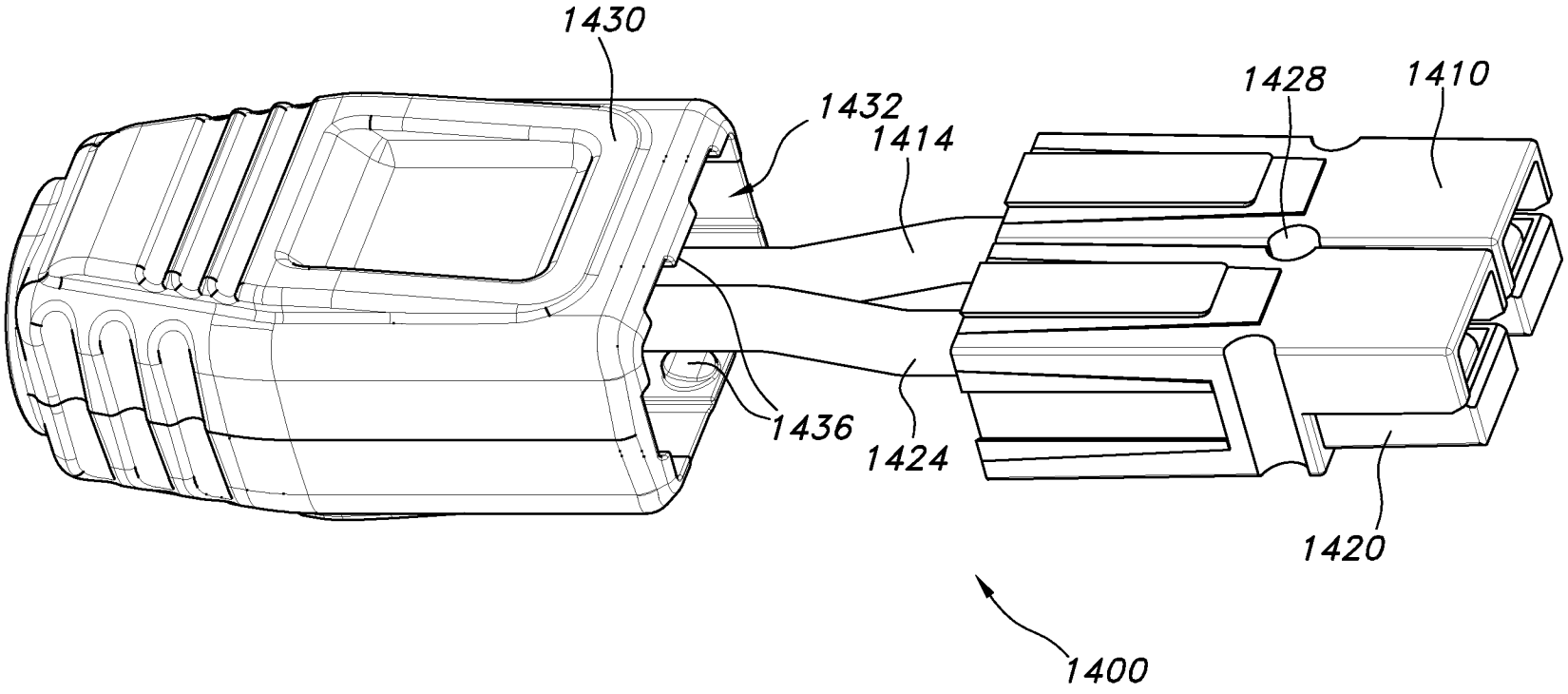
FIG. 15 is an exploded view of the electrical connector shown in FIG. 14.
Figure 16:
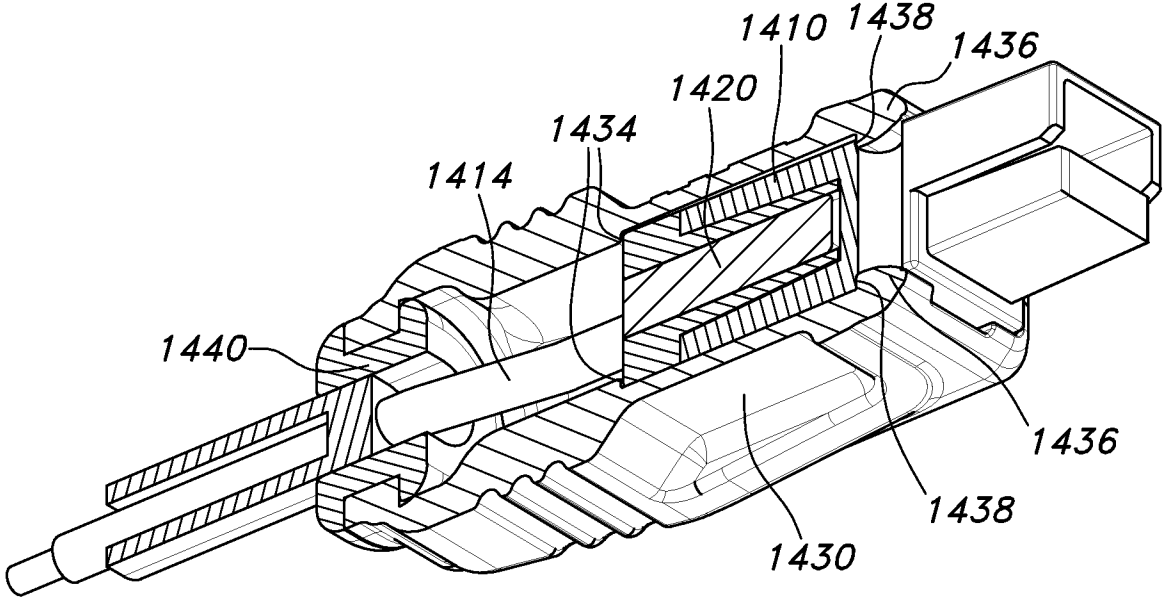
FIG. 16 illustrates a side cutaway view of the electrical connector taken along lines 16-16 shown in FIG. 14.

As shown best in FIGS. 14 and 16, the protective boot 1430 also includes a rubber grommet 1440 configured to provide strain relief for the wires (1414, 1424) connected to the electrical contacts (1412, 1422). The rubber grommet 1440 is configured to absorb push, pull, and twisting forces that the wires (1414, 1424) may be subjected to during use.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present invention. Thus, the phrase "in some embodiments" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A portable water pump assembly comprising:

an electric water pump configured to move water, the electric water pump comprising a pump motor, an inlet port, and an outlet port;

a suction-intake arm assembly connected to the inlet port;

a discharge arm assembly connected to the outlet port; and a chassis configured to dampen vibrations generated by the electric water pump during operation, the chassis comprising a baseboard and a yoke;

wherein:

the baseboard includes one or more vibration isolators on an underside thereof; and the yoke comprises a first opening configured to fit about a portion of the electric water pump, a second opening configured to support one end of the suction-intake arm assembly, and a third opening configured to support one end of the discharge arm assembly.

2. The portable water pump assembly of claim 1, wherein the yoke further comprises a tab extending from a bottom edge of the yoke, and the baseboard includes a slot configured to receive the tab of the yoke.

3. The portable water pump assembly of claim 1, wherein the first opening of the yoke is lined with an elastomeric material that dampens vibrations generated by the electric water pump during operation.

4. The portable water pump assembly of claim 1, wherein the first opening of the yoke is lined with a length of elastomeric material that dampens vibration generated by the electric water pump during operation, and the length of elastomeric material includes a longitudinally extending groove configured to receive therein an inner edge defining the first opening.

5. The portable water pump assembly of claim 1, further comprising at least one elastomeric bushing positioned between a top side of the baseboard and an underside of the electric water pump.

6. The portable water pump assembly of claim 5, wherein the at least one elastomeric bushing is a hollow cylinder made of an elastomer.

7. The portable water pump assembly of claim 1, wherein:

the suction-intake arm assembly comprises an elbow fitting connected to the inlet port of the electric water pump, an inline filter configured to filter water being drawn into the electric water pump, and a hose adapter to which a hose can be attached; and the discharge arm assembly comprises an elbow fitting connected to the outlet port of the electric water pump and a hose adapter to which a hose can be attached.

8. The portable water pump assembly of claim 7, wherein the second opening of the yoke is configured to fit about the hose adapter on the suction-intake arm assembly, and the third opening of the yoke is configured to fit about the hose adapter on the discharge arm assembly.

9. The portable water pump assembly of claim 1, further comprising a pair of handles positioned on opposite ends of the baseboard.

10. The portable water pump assembly of claim 9, wherein each of the pair of handles includes a pair of spaced apart legs extending from a square bend.

11. The portable water pump assembly of claim 1, further comprising a power supply that includes an electronic circuit contained within an electronics enclosure, wherein the electronic circuit comprises a printed circuit board configured to protect the electric water pump from overcurrent, the printed circuit board comprises an inrush current limiter and a removable fuse, the inrush current limiter is configured to prevent an EMF surge from damaging the removable fuse.

* * * * *